US006215075B1

(12) United States Patent
Pazdirek

(10) Patent No.: US 6,215,075 B1
(45) Date of Patent: Apr. 10, 2001

(54) COMPOSITE INSULATOR

(75) Inventor: Jiri Pazdirek, Schaumburg, IL (US)

(73) Assignee: MacLean-Fogg Company, Franklin Park, IL (US)

( * ) Notice: Subject to any disclaimer, the term of this patent is extended or adjusted under 35 U.S.C. 154(b) by 0 days.

(21) Appl. No.: 09/413,098

(22) Filed: Oct. 5, 1999

Related U.S. Application Data

(63) Continuation of application No. 08/230,417, filed on Apr. 19, 1994, now abandoned, which is a continuation of application No. 08/082,063, filed on Jun. 23, 1993, now abandoned, which is a continuation of application No. 07/898,075, filed on Jun. 12, 1992, now abandoned.

(51) Int. Cl.[7] ..... H01B 17/06
(52) U.S. Cl. ..... 174/178; 174/209; 174/195
(58) Field of Search ..... 174/176, 177, 174/178, 179, 189, 195, 196, 168, 140 S, 209, 211, 212

(56) References Cited

U.S. PATENT DOCUMENTS

| | | | | |
|---|---|---|---|---|
| 3,898,372 | * | 8/1975 | Kalb | 174/179 |
| 4,217,466 | * | 8/1980 | Kuhl | 174/209 |
| 4,246,696 | * | 1/1981 | Bauer et al. | 29/631 |
| 5,159,158 | * | 10/1992 | Sakich et al. | 174/179 |
| 5,374,780 | * | 12/1994 | Pazirek | 174/176 |

* cited by examiner

*Primary Examiner*—Kristine Kincaid
*Assistant Examiner*—Charlie C. Nguyen
(74) *Attorney, Agent, or Firm*—Richard G. Lione; Brinks Hofer Gilson & Lione

(57) ABSTRACT

A weathershed for use in a composite insulator includes a molded polymer body. The body configuration is such that the leakage distance across the weathershed is increased, while at the same time the amount of material needed is reduced. This provides a lightweight and easily manufactured weathershed. The weathershed includes a radially curved outer edge which reduces the electric field gradient and also reduces the tendency to trap contaminants.

4 Claims, 2 Drawing Sheets

COMPOSITE INSULATOR

RELATED APPLICATIONS

This application is a continuation of application Ser. No. 08/230,417, filed Apr. 19, 1994 now abandoned which is a continuation of application Ser. No. 08/082,063, filed Jun. 23, 1993 now abandoned which is a continuation of Ser. No. 07/898,075 filed Jun. 12, 1992 now abandoned.

FIELD OF THE INVENTION

This invention relates in general to electric power transmission line insulators. More particularly, it relates to an improved weathershed for a composite insulator.

BACKGROUND OF THE INVENTION

Insulators are used to prevent the loss of electric charge or current from conductors in electric power transmission lines. A typical insulator is made from a material which has a very high resistance to electric current so that current flow through it is negligible. One type of insulator is referred to as a suspension insulator. It suspends a transmission line from an overhead support. A particular type of suspension insulator is referred to as a composite insulator.

A composite insulator may include a coated fiberglass rod surrounded by weathersheds made from a highly insulating material (see, for example, Kuhl U.S. Pat. No. 4,217,466, or, Bauer U.S. Pat. No. 4,246,696). A common approach has been to cover the fiberglass rod with an insulating coating. The weathersheds are molded from rubber or other polymeric material and then bonded to the coated rod using a polymer based adhesive. Metal fittings are provided at each end of the rod for connecting one end to a support pylon and the other end to a power line.

The weathersheds and the fiberglass rod are made from different material in order to enhance the performance of the two components in their distinct functions. In general, the rod takes the mechanical stress and contributes to the insulation function, while the weathersheds provide the majority of the insulation. The weathersheds also increase the distance which leakage currents must travel from one metal fitting to the other. The weathersheds must be fitted in such a way that no electric conduction can occur through the seam between a weathershed and the coated rod. Each weathershed must have good stability in all weather conditions. Furthermore, it must be of sufficient thickness to prevent its electrical resistance from being overcome. Additional information regarding the operation and construction of composite insulators may be found in U.S. Pat. Nos. 3,898,372; 4,267,403; 4,331,833; and 4,355,200.

BRIEF SUMMARY OF THE INVENTION

A primary object of the present invention is to provide an improved weathershed for composite insulators.

It is another object to provide a weathershed which is lightweight and easy to manufacture.

It is a further object to provide a weathershed having a reduced electric field gradient.

It is still another object to provide a weathershed having a reduced tendency to trap contaminants such as dust, water and air pollutants.

It is yet another object to provide a weathershed which creates a maximum leakage current distance.

The foregoing and other objects are realized in accord with the present invention by providing a weathershed having a molded body with a hub and a skirt. The thickness of the skirt is substantially uniform from the hub to its annular outer edge. This maximizes leakage current distance while, at the same time, minimizing material usage. The annular outer edge is radially curved between upper and lower faces of the skirt to reduce the value of the electric field gradient. Other edges or external corners on the body are also curved.

BRIEF DESCRIPTION OF SEVERAL VIEWS OF THE DRAWINGS

The invention, including its construction and method of operation, together with additional objects and advantages thereof, is illustrated in the following drawings, in which.

DETAILED DESCRIPTION OF THE INVENTION

Figure 1:
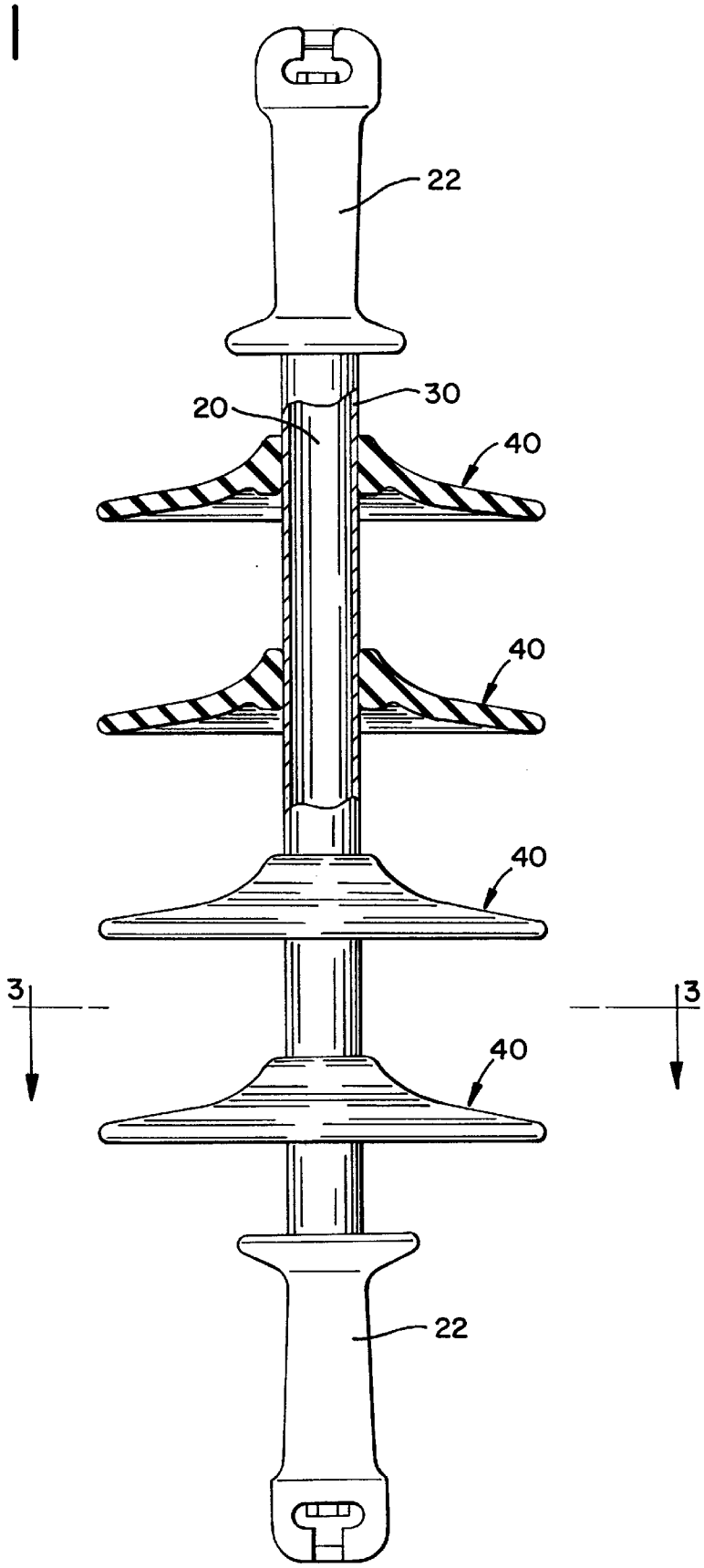
FIG. 1 illustrates a composite insulator embodying features of the present invention.

FIG. 1 illustrates a composite insulator 10 embodying the present invention. The insulator 10 may be used to insulate any of a variety of electric power transmission lines (not shown), including high tension lines (typically 100–400 KV) or distribution lines (typically 15–35 KV). A transmission line normally includes a set of conductors, usually bare, which are supported by a series of supporting structures such as wooden H-frames or steel towers, for example. With a distribution line, the supporting structures may be conventional wood poles.

The insulator 10 may be connected to the power line in variety of connection configurations, including "suspension," "deadend" and "post" connections. The general structure of the insulator 10 is essentially the same, regardless of the manner in which it is connected to the power line or the support.

As shown in FIG. 1, the composite insulator 10 comprises a rod 20, a shield layer 30 and a plurality of weathersheds 40 fastened to the shielded rod. Metal fittings 22 are attached to each end of the rod 20 for connecting one end of the rod to a support pylon (not shown) and the other end to a power line (also not shown).

Suitable materials and methods of construction for the rod 20 and the shield layer 30 are described in U.S. Pat. No. 4,217,466 to Kuhl, and U.S. Pat. No. 4,246,696 to Bauer et al. Suitable materials for the weathersheds 40, along with adhesives and methods for attaching the weathersheds 40 to the shield layer 30, are also disclosed in Kuhl and Bauer et al. The entire disclosures of both of these patents are incorporated herein by reference.

The rod 20 is generally elongated and may be made as a composite structure from glass fibers and a resin produced by pultrusion. Since the rod 20 must support the entire tension load to which the insulator 10 is subjected, it is important that the rod be of high mechanical strength as well as high dielectric strength. The glass fibers are resin bonded into an elongated, cylindrical rod 20 having a smooth exterior surface of substantially uniform diameter. The bonding resin must provide a good mechanical bond and have high dielectric strength to ensure that the completed rod will have the desired insulation capability. However, the tensile strength of the rod is imparted, in large measure, by the fibers. Accordingly, it is desirable that the fibers constitute a large part of the cross section of the rod.

The rod 20 has an extrusion applied shield layer 30 which consists of an envelope of silicone or other elastomer that is current peak-proof and weather resistant. The shield 30 provides an intermediate layer of material between the rod 20 and the weathersheds 40. The shield 30 protects the rod 20 from deleterious material and may be made from a mono-functional or poly-functional polymer. Each weathershed 40 is mounted on the rod 20 by inserting the rod through an aperture 43 (see FIG. 3) in the weathershed 40. The weathersheds 40 may be secured to the shield layer 30 with an adhesive. Alternatively, the weathersheds 40 and the shield layer 30 may be cross-linked together.

Figure 2:
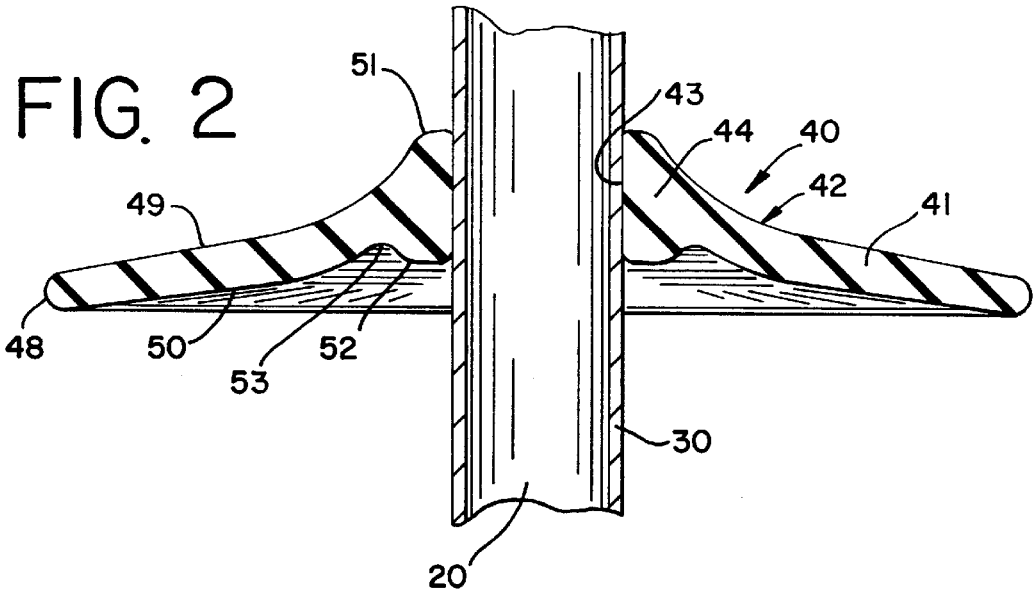
FIG. 2 is a vertical sectional view taken through a portion of the insulator shown in FIG. 1.
Figure 3:
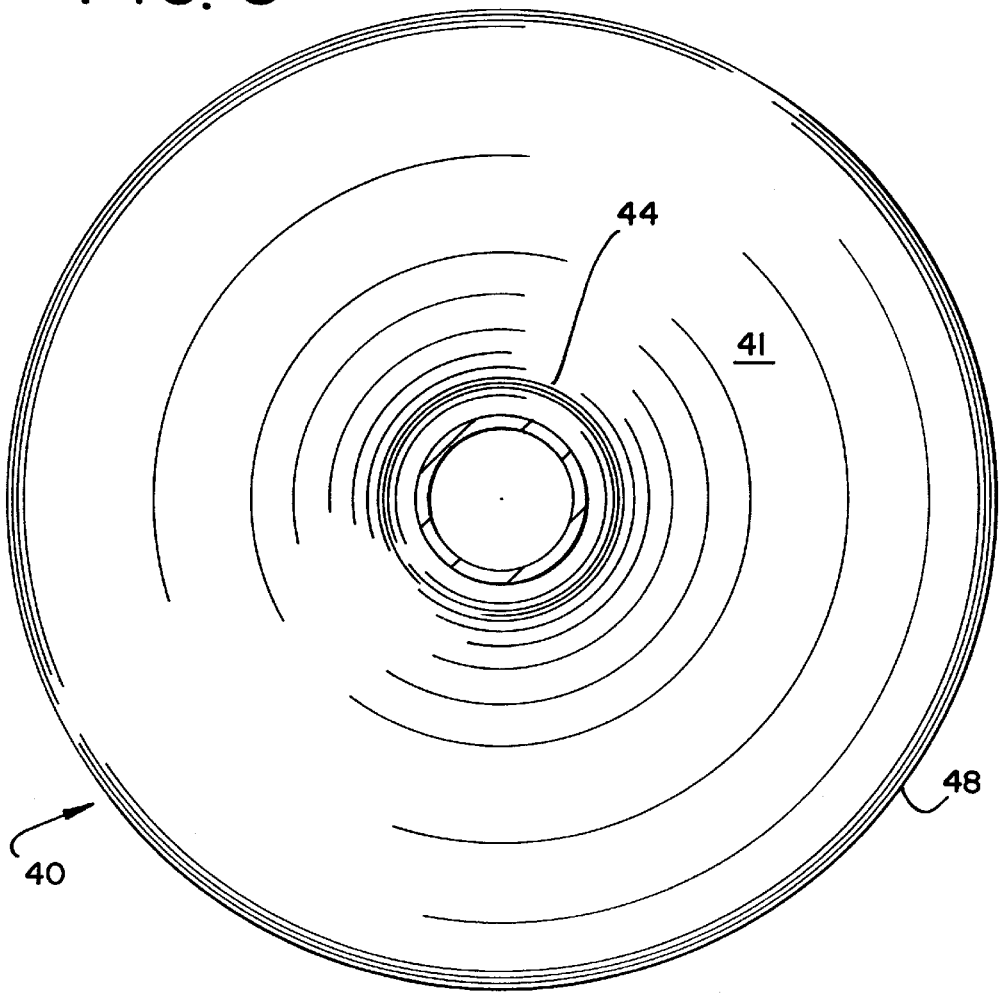
FIG. 3 is an enlarged sectional view taken along line 3—3 of FIG. 1.

Turning now to FIGS. 2 and 3, the construction of a weathershed 40 is illustrated in greater detail. The weathershed 40 is preferably molded from a flexible, yet sturdy, synthetic material. Molding is accomplished by conventional injection and/or compression molding techniques. Suitable synthetic materials include EPDM rubber, silicone rubber, and other materials having similar properties. In the preferred embodiment shown, silicone rubber is employed.

The weathershed 40 has a disc-like body 42 with a slight bell shape. The body 42 includes a central hub 44 through which the aperture 43 extends, and an outwardly extending skirt 41. Being disc-like, the hub 44 and skirt 41 together form a flattened round body 42. An adhesive primer is applied to the internal face of the aperture 43 to bond the weathershed 40 to the shield layer 30 on the rod 20.

The annular outer edge 48 of the skirt 41 is radially curved between the upper face 49 and lower face 50 of the skirt 41. This continuously rounded edge 48 configuration reduces the value of the electric field gradient across the weathershed 40. This edge 48 configuration also reduces the tendency to trap contaminants such as dust or water, for example, on the upper face 49 of the skirt 41. Two other external edges or corners 51 and 52 on the hub 44 are also continuously curved for the same purpose.

The skirt 41 of the weathershed 40 has a substantially uniform thickness. To accomplish this the lower face 50 extends substantially parallel to the upper face 49 from the outer edge 48 of the skirt 41 to the hub 44 of the weathershed 40. As a result, an annular depression 58 is formed around the hub 44 in the lower face 50. The rounded corner 52 defines the lower extremity of an external face on the hub 44. Uniform thickness is maintained throughout the skirt 41 of the weathershed 40 without compromising the vertical height of the hub 44. The skirt 41 curves downwardly (as seen in cross-section in FIG. 2) and outwardly from the hub 44 at a decreasing radius of curvature so that an inner portion of the skirt adjacent the hub has the aforementioned bell shape and the outer portion of the skirt is shaped like a flattened frustum of a cone. Consequently, the surface area of the internal aperture 43 face is also maximized, resulting in an increased bonding surface for attaching the weathershed 40 to the shield layer 30 on the rod 20. The distance from the internal aperture 43 face of the hub 44 to the outer edge 48 of the skirt 41 is also maximized, thus maximizing the travel distance for leakage current. As best seen in FIG. 2, the hub 44 is thickened along its entire height, which is three-quarters of the overall height of the body. The thickness of the hub 44, from its external upper edge 51 to its external lower edge 52, is as great or greater than the thickness of the skirt 41 throughout its height.

The weathershed 40 configuration which has been described minimizes the material needed to manufacture the weathershed. Thus, the weight of the weathershed 40 is minimized. The use of a reduced amount of material allows a faster process cycle to be utilized when curing the weathershed 40 during manufacture. In particular, the depression 53 allows better and faster penetration of curing heat into the body 42 of the weathershed 40. Overall production quality is improved while providing a less expensive product.

While a preferred embodiment of the invention has been described, it should be understood that the invention is not limited to it. Modifications may be made without departing from the invention. The scope of the invention is defined by the appended claims, and all devices that come within the meaning of the claims, either literally or by equivalence, are intended to be embraced therein.

What is claimed is:

1. A composite insulator comprising:

a) a rod having a shield layer and a plurality of weathersheds fastened to the rod through the shield layer;

b) each of said weathersheds comprising a body molded in one piece from a rubber-like material;

c) said body having a disc-like configuration and including a central hub and a skirt extending radially outwardly from said hub so as to define a slight bell shape;

d) the height of the hub being more than one-half the overall height of the body;

e) an aperture in said central hub having an internal face with a substantially uniform diameter along the full height of the hub;

f) said skirt having an upper face and a lower face extending from said hub to an annular outer edge which is curved between said upper and lower faces;

g) an annular depression formed in said lower face, spaced outwardly from said rod and around said hub;

h) said annular depression defining an external face on said hub and a portion of said lower face of said skirt;

i) a continuously curved, external lower edge on said hub below said skirt and spaced outwardly from said rod;

j) a continuously curved upper edge on said hub above said skirt and spaced outwardly from said hub;

k) the configuration of said annular depression being such that said portion of said lower face extends substantially parallel to a corresponding portion of said upper face; and l) said skirt having a substantially uniform thickness and curving downwardly and then upwardly between said hub and said annular outer edge.

2. A composite insulator comprising:

a) a rod having a shield layer and a plurality of weathersheds fastened to the rod through the shield layer;

b) each of said weathersheds comprising a body molded in one piece from a rubber-like material;

c) said body having a disc-like configuration and including a central hub and a skirt extending radially outwardly from said hub so as to define a slight bell shape;

d) the height of the hub being more than one-half the overall height of the body;

e) an aperture in said central hub having an internal face with a substantially uniform diameter along the full height of the hub;

f) said skirt having an upper face and a lower face extending from said hub to an annular outer edge which is curved between said upper and lower faces;

g) an annular depression formed in said lower face, spaced outwardly from said rod and around said hub;

h) said annular depression defining an external face on said hub and a portion of said lower face of said skirt;

i) a continuously curved, external lower edge on said hub below said skirt and spaced outwardly from said rod;

j) a continuously curved upper edge on said hub above said skirt and spaced outwardly from said hub;

k) the configuration of said annular depression being such that said portion of said lower face extends substantially parallel to a corresponding portion of said upper face; and l) said skirt having a substantially uniform thickness between said hub and said annular outer edge; and m) the thickness of said hub between said external upper edge and said external lower edge being as great or greater than the thickness of said skirt.

3. The composite insulator of claim 2 further characterized in that:

a) said skirt curves downwardly and then upwardly from said hub to said annular outer edge.

4. A weathershed for a composite insulator wherein said insulator includes a rod having a shield layer, said weathershed comprising:

a) a body molded in one piece from a rubber-like material;

b) said body having a disc-like configuration and including a central hub and a skirt extending radially outwardly from said hub;

c) the height of the hub being more than one-half the overall height of the body;

d) a rod receiving aperture in said central hub having an internal face with a substantially uniform diameter along the full height of the hub;

e) said skirt having an upper face and a lower face extending from said hub to an annular outer edge which is curved between said upper and lower faces; and f) an annular depression formed in said lower face, spaced outwardly from said rod and around said hub;

g) said annular depression defining an external face on said hub and a portion of said lower face of said skirt;

h) the configuration of said annular depression being such that said portion of said lower face extends substantially parallel to a corresponding portion of said upper face; and i) said skirt having a substantially uniform thickness between said hub and said annular outer edge.

j) said skirt curving downwardly and outwardly from said hub at a decreasing radius of curvature so that an inner portion of said skirt has a bell shape and the outer portion of said skirt is shaped like a flattened frustum of a cone.

* * * * *